US010850899B2

(12) United States Patent
Dedman

(10) Patent No.: US 10,850,899 B2
(45) Date of Patent: Dec. 1, 2020

(54) LOW PROFILE FUNNEL

(71) Applicant: Trevor Dedman, Woodstock (CA)

(72) Inventor: Trevor Dedman, Woodstock (CA)

( * ) Notice: Subject to any disclaimer, the term of this patent is extended or adjusted under 35 U.S.C. 154(b) by 36 days.

(21) Appl. No.: 16/090,402

(22) PCT Filed: Mar. 30, 2017

(86) PCT No.: PCT/CA2017/050387
§ 371 (c)(1),
(2) Date: Oct. 1, 2018

(87) PCT Pub. No.: WO2017/165971
PCT Pub. Date: Oct. 5, 2017

(65) Prior Publication Data

US 2019/0152662 A1 May 23, 2019

Related U.S. Application Data

(60) Provisional application No. 62/315,272, filed on Mar. 30, 2016.

(51) Int. Cl.
*B65D 51/24* (2006.01)
*B65D 51/20* (2006.01)

(52) U.S. Cl.
CPC ..... *B65D 51/24* (2013.01); *B65D 51/20* (2013.01); *B65D 2251/0015* (2013.01); *B65D 2251/0018* (2013.01); *B65D 2251/0093* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,715,063 | A * | 2/1973 | Susuki | B65D 47/122 222/545 |
| 4,682,689 | A * | 7/1987 | Pereira | B65D 81/3211 206/222 |
| 5,844,952 | A * | 12/1998 | Ito | H04L 1/08 375/347 |
| 6,446,827 | B1 * | 9/2002 | Akins | B44D 3/12 220/570 |
| 6,450,351 | B1 | 9/2002 | Thompson | |
| 9,346,657 | B2 | 5/2016 | Hanson | |
| 2002/0166879 | A1 * | 11/2002 | Steen | B65D 39/06 222/500 |
| 2012/0037669 | A1 | 2/2012 | Goetz et al. | |

FOREIGN PATENT DOCUMENTS

| | | |
|---|---|---|
| EP | 2366635 | 9/2011 |

* cited by examiner

*Primary Examiner* — James N Smalley
(74) *Attorney, Agent, or Firm* — Bereskin & Parr LLP/S.E.N.C.R.L., s.r.l.

(57) ABSTRACT

A container comprising a receptacle, a lid, and a funnel is disclosed. The receptacle defines an interior storage chamber and has an upper rim defining a top opening. The lid is removably attachable to the receptacle for enclosing the top opening. The lid comprises an interior surface. The lid defines an interior headspace between the upper rim of the receptacle and the interior surface of the lid. The funnel comprises a unitary body shaped to fit within the interior headspace.

19 Claims, 6 Drawing Sheets

LOW PROFILE FUNNEL

RELATED APPLICATIONS

This application claims the benefit of U.S. Provisional Patent Application Ser. No. 62/315,272 filed Mar. 30, 2016 and entitled LOW PROFILE FUNNEL, the entire contents of which are hereby incorporated herein for all purposes.

FIELD

The embodiments described herein relate to the field of containers, and in particular, containers for storing substances that are subsequently transferred through a small opening for use, or storage in another container.

INTRODUCTION

Various substances in powder or liquid form are stored in containers and subsequently transferred to another container for use or for storage. A spoon may be used to scoop the substance from the initial container and transferred into the second container. Funnels may also be used to pour the substance from the initial container into the second container. Funnels can reduce spillage when pouring substances into second containers having smaller openings than the initial container.

Food and consumable products frequently come in the form of powders or liquids that can be added to other liquids and foods. For example, protein shakes can be a dry powder that is added to a liquid base, such as water or milk, in a bottle or cup. The dry powder can be stored in a bulk container. That is, only a portion of the total stored substance is required for a single usage. Since, protein shakes are often consumed "on-the-go", access to a spoon for transferring the dry powder may not be available.

SUMMARY

According to some embodiments, there is a container comprising a receptacle, a lid, and a funnel. The receptacle defines an interior storage chamber and has an upper rim defining a top opening. The lid is removably attachable to the receptacle for enclosing the top opening. The lid comprises an interior surface. The lid defines an interior headspace between the upper rim of the receptacle and the interior surface of the lid. The funnel comprises a unitary body shaped to fit within the interior headspace.

The container may further comprise a seal for covering the top opening. The seal may be received by the upper rim.

The seal may provide a frangible barrier between the interior storage chamber and the interior headspace.

The frangible barrier may remain unbroken when the funnel is placed within the interior headspace.

The seal may be formed of at least one of a foil, plastic, and paper.

The funnel may be removably attachable to the interior headspace.

The unitary body of the funnel may be temporarily deformable for removing the funnel from the interior headspace.

The receptacle may further comprise a fastening member disposed along an outer surface of the receptacle.

The lid may further comprise a fastening member that is complementary to the fastening member of the receptacle for removably attaching the lid to the receptacle.

Further aspects and advantages of the embodiments described herein will appear from the following description taken together with the accompanying drawings.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1A:
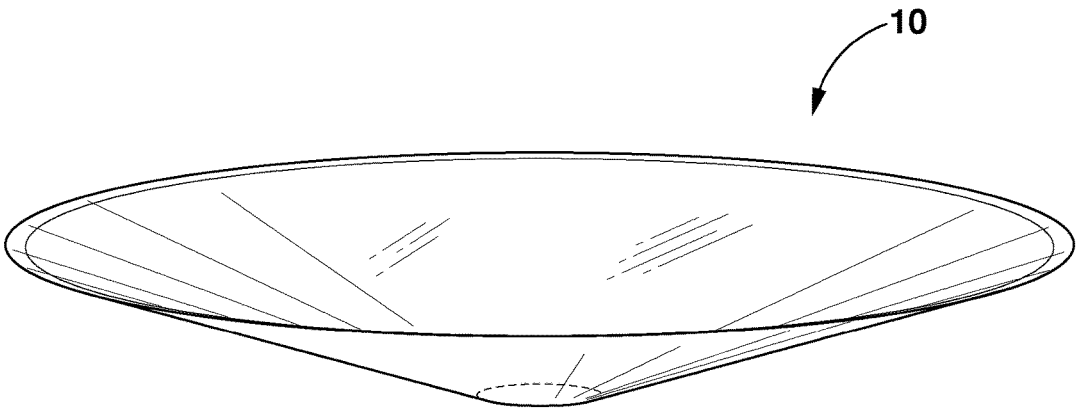
FIG. 1A is a perspective view of a funnel according to one embodiment.

The skilled person in the art will understand that the drawings, described below, are for illustration purposes only. The drawings are not intended to limit the scope of the applicants' teachings in anyway. Also, it will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF VARIOUS EMBODIMENTS

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

It should be noted that terms of degree such as "substantially", "about" and "approximately" when used herein mean a reasonable amount of deviation of the modified term such that the end result is not significantly changed. These terms of degree should be construed as including a deviation of the modified term if this deviation would not negate the meaning of the term it modifies.

In addition, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that the term "coupled" used herein indicates that two elements can be directly coupled to one another or coupled to one another through one or more intermediate elements.

Figure 1B:
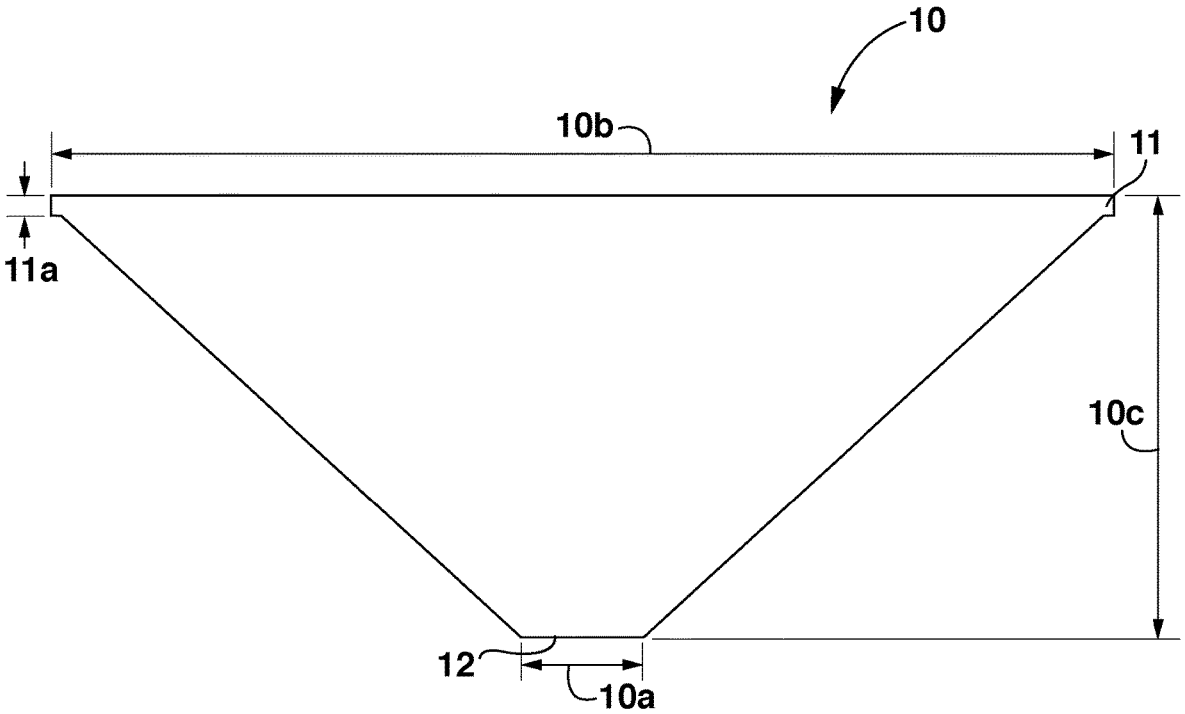
FIG. 1B is a side view of the funnel of FIG. 1A.

Referring to FIGS. 1A and 1B, there is a funnel 10 according to at least one embodiment. The funnel 10 may be used to reduce spillage when transferring substances through a small opening. The small opening may be a small opening of another container, vessel, canister, or cup for immediate use or for storage of the substance. The funnel 10 includes a unitary body shaped to have an inlet end and an outlet end. The outlet end can define a rim 12. The width 10*b* of the inlet end is wider than the width 10*a* of the outlet end. In the case of a round funnel, the diameter 10*b* of the inlet end is greater than the diameter 10*a* of the outlet end. The unitary body generally has a hollow structure defining an inner surface and an outer surface.

When the funnel 10 is in use, the outlet end is placed into the small opening of the other container with the outer surface in contact with the opening of the receptacle. Substances are poured onto the inner surface at the inlet end of the funnel 10. Guided by the funnel 10, substances exit the outlet end and are transferred into the other container.

The distance from the wider inlet end of the funnel 10 to the narrower outlet end generally defines a funnel height 10*c*, or profile. The funnel 10 may be referred to as a low profile funnel because the funnel height 10*c* is relatively smaller than the width 10*b* of the inlet end.

In some embodiments, the inlet end can include a lip 11 disposed along the inlet end. The lip 11 can have a thickness 11*a* defined by the distance between a top surface at the lip 11, or inner surface of the funnel 10 and a bottom surface at the lip 11, or outer surface of the funnel.

In some embodiments, the funnel 10 is formed of a flexible material. In the absence of pressure, the funnel 10 maintains its shape. The flexible material allows the shape of the funnel 10 to be temporarily deformed when pressure is applied to the funnel 10. When pressure to the funnel 10 is released, the funnel 10 can return to its original shape.

Figure 2:
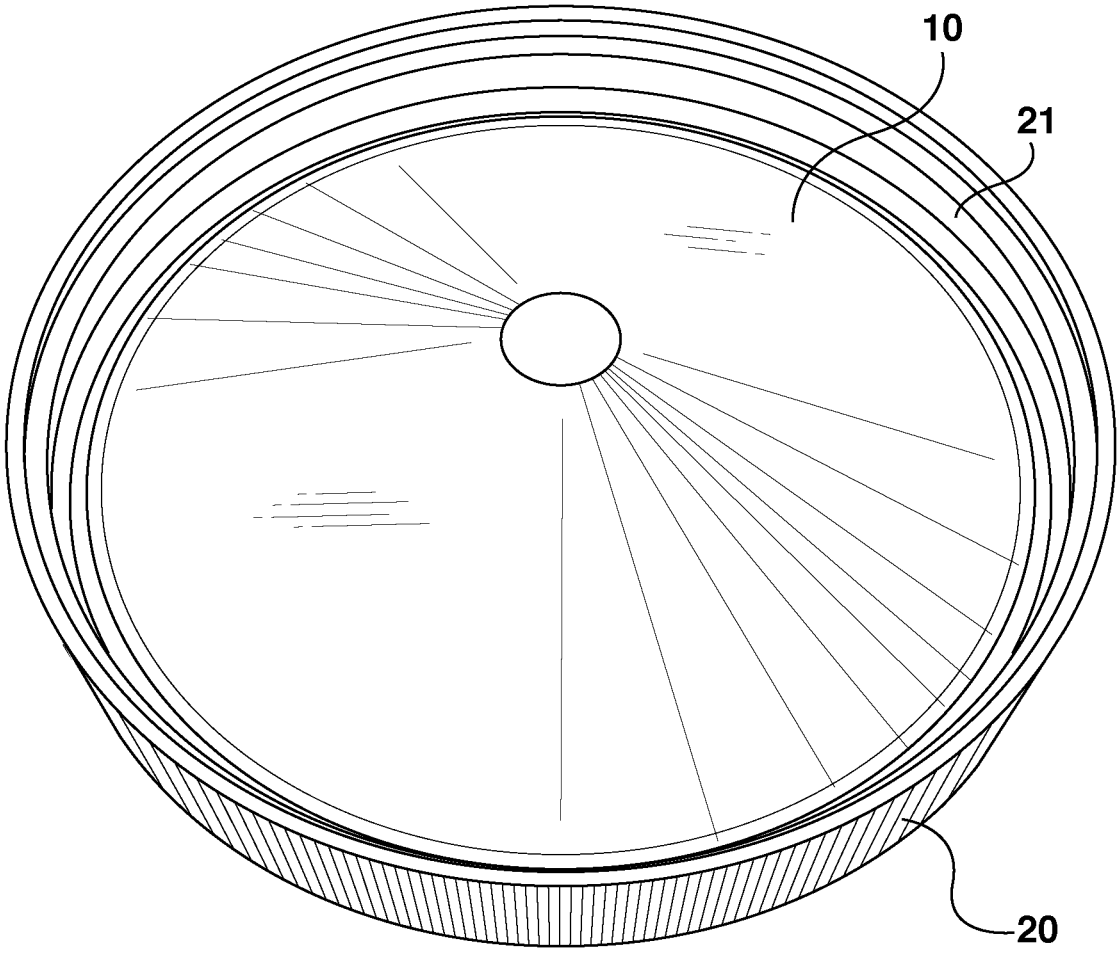
FIG. 2 is a perspective view of the funnel of FIG. 1A placed within a lid.
Figure 3:
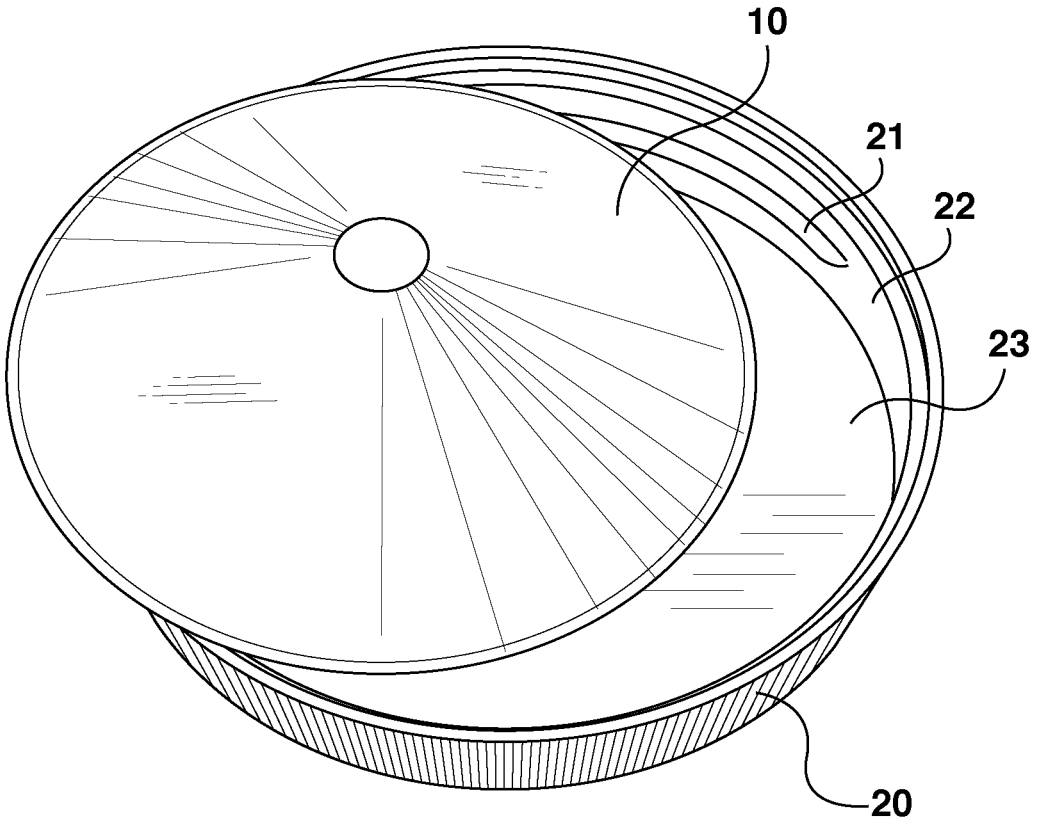
FIG. 3 is a perspective view of the funnel and lid of FIG. 2.

With reference to FIGS. 2 and 3, the funnel 10 can be sized to fit within a lid 20. Lid 20 includes a body for enclosing an opening of a receptacle. The lid 20 includes an interior surface 23. The interior surface 23 faces the opening of the receptacle when the lid 20 is attached to the receptacle. The interior surface 23 can be generally flat.

The lid 20 also includes an interior sidewall 22. As shown in FIGS. 2 and 3, the interior sidewall 22 can be generally perpendicular to the interior surface 23. In some embodiments, the interior sidewall 22 may not be perpendicular to the interior surface 23. Instead, the interior sidewall 22 may be curved. The interior sidewall 22 may form a dome that is capped by the interior surface 23. As shown in FIG. 2, the width 10*b* of the inlet end can be smaller than the interior sidewall 22 of the lid 20 so that the funnel 10 can be placed within the lid 20 without deformation to the shape of the funnel 10.

The interior surface 23 and the interior sidewall 22 can define an interior headspace, nook, or cavity. More specifically, the interior surface 23 can define an upper boundary of the interior headspace. The interior sidewall 22 can define side boundaries of the interior headspace. As shown in FIG. 2, when the funnel 10 is placed within the lid 20, the funnel 10 sits within the interior headspace.

In some embodiments, the funnel 10 can be removably attachable to the interior headspace. When the funnel 10 is attached to the interior headspace, the funnel remains attached to the lid 20 when the lid 20 is inverted, or flipped, from the orientation, or position shown in FIG. 2. That is, the funnel 10 will not detach from the lid 20 when the lid 20 is used to cover a top opening of a receptacle.

In some embodiments, the lid 20 includes means for removably attaching the funnel 10 to the interior headspace. Any appropriate attaching means may be provided. In at least one embodiment, the attaching means may be one or more protruding seats, or members, provided along the interior sidewall 22 for holding, or maintaining the funnel 10 within the interior headspace of the lid 20. The protruding seats generally protrude outwardly from the surface of the interior sidewall 22. The protruding seats can be rigid. The protruding seats can be sized to support the weight and shape of the funnel 10.

As shown in FIG. 2, the inlet end of the funnel 10 may be placed adjacent to the interior surface 23 of the lid 20. In some embodiments, to hold, or retain the inlet end of the funnel 10 adjacent to, or against, the interior surface 23 of the lid 20, the protruding seats can be located at a distance that accommodates the lip at the inlet end of the funnel 10. That is, the protruding seats can be spaced a distance from the interior surface 23 that is at least the thickness 11*a* of the lip 11 at the inlet end of the funnel 10.

In other embodiments, the outlet end of the funnel 10 may be placed adjacent to the interior surface 23 of the lid 20. In some embodiments, to hold, or retain the outlet end of the funnel 10 adjacent to, or against, the interior surface 23 of the lid 20, the protruding seats can be located at a distance from the interior surface 23 of the lid 20 that accommodates the height, or profile of the funnel. That is, the protruding seat can be spaced a distance from the interior surface 23 that is at least the funnel height 10*c*.

In some embodiments wherein one or more protruding seats are provided as the attaching means, the funnel 10 can be temporarily deformable for attaching and detaching the funnel 10 from the lid 20. That is, the funnel 10 may be temporarily deformed, or contorted, in order to place the funnel 10 within interior headspace, between the interior surface 23 and the protruding seats. Similarly, the funnel 10 may be temporarily deformed in order to remove the funnel 10 from the interior headspace.

In some embodiments, the attaching means may be one or more clasps provided along the interior surface 23 of the lid 20 for holding, gripping, or retaining the outlet end of the funnel 10 adjacent to, or again, the interior surface 23 of the lid 20. The one or more clasps, or funnel clasps, can be spikes, hooks, or pins that protrude outwardly from the interior surface 23 of the lid 20. The spikes can be spaced to fit within the outlet end of the funnel 10. The spikes can be biased in a direction away from the center of the spikes, or in a direction towards the interior sidewall 22 of the lid 20. The bias of the spikes can apply pressure in an outward direction towards the inner surface at the outlet end of the funnel 10. The spikes can have a ridge to sit against the rim 12 of the outlet end of the funnel 10. In such cases, the funnel 10 is rigid and does not deform. The pressure of the spikes, against the rigid, unitary body creates tension to hold the funnel 10 in place. To remove, or release the funnel 10 from the lid 20, the spikes can be pinched together, or in a direction away from the interior sidewall 22 of the lid.

In some embodiments, the attaching means may include one or more magnets. In some embodiments, the funnel 10 may produce a magnetic field that is attracted to a metallic interior surface 23 of the lid 20. The magnetic field of the funnel 10 may be caused by magnets embedded within the funnel 10. In particular, the magnets may be embedded within the rim 12 of the outlet end of the funnel 10.

Alternatively, the funnel 10 may be formed of a magnetic material. In some embodiments, the interior surface 23 of the lid 20 may produce a magnetic field that is attracted to a metallic funnel 10. The magnetic field of the lid 20 may be produced by magnets embedded within the interior surface 23 of the lid 20. Alternatively, the interior surface 23 of the lid 20 may be formed of a magnetic material.

The lid 20 can be removably attachable to the receptacle. Any appropriate attaching means, or fastening means 21 may be provided to removably attach, or removably fasten the lid 20 to the receptacle. As shown in FIGS. 2 and 3, the fastening means 21 can be threading disposed along the interior sidewall 22 of the lid 20 for receiving complementary threading of the receptacle.

Figure 4B:
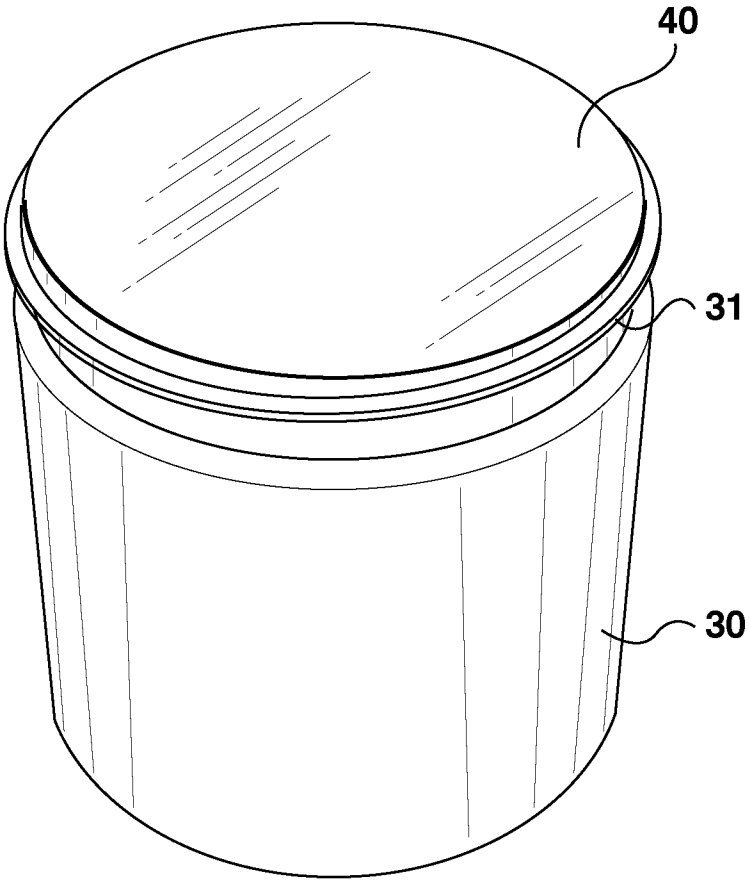
FIG. 4B is a perspective view of the receptacle of FIG. 4A with a seal covering the top opening.
Figure 4A:
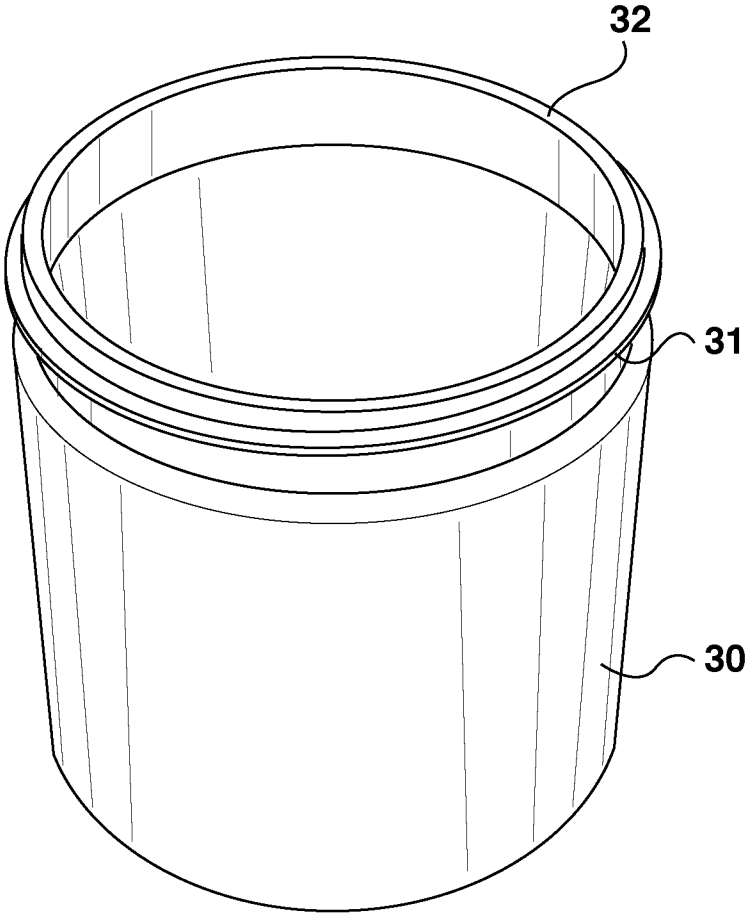
FIG. 4A is a perspective view of a receptacle having a top opening according to one embodiment.

Reference is made to FIG. 4A, which illustrates a receptacle 30 having a top opening that can be enclosed by the lid 20. The receptacle 30 generally has a hollow structure defining an interior storage chamber. The receptacle 30 can be used to store, or hold substances within the interior storage chamber. The receptacle 30 can include an upper rim 32 defining the top opening for transferring substances to and from the interior storage chamber. The upper rim 32 also defines a lower boundary of the interior headspace of the lid 20.

The receptacle 30 can include attaching means, or fastening means 31, to removably attach the lid 20 to the receptacle 30. The fastening means 31 provided on the receptacle 30 are complementary, or correspond to, the fastening means 21 provided on the lid 20. As shown in FIG. 4A, the fastening means 31 can be threading disposed along an outer surface of the receptacle 30. When disposed along the outer surface of the receptacle 30, the threading of the receptacle 30 can receive the threading of the lid 20 disposed along the interior sidewall 22 of the lid 20.

In some embodiments, the fastening means 31 provided on the receptacle 30 can include a lip that protrudes from the outer surface of the receptacle 30. The corresponding fastening means 21 provided on the lid 20 can comprise one or more flaps having ridges disposed on the same side of the flap as the interior sidewall 22. With the lid 20 enclosing the top opening of the receptacle 30, the flaps can be pushed towards to receptacle 30 to grip the lip on the outer surface of the receptacle 30. The ridges of the flaps can sit against the lip of the outer surface of the receptacle 30.

With reference to FIG. 4B, the upper rim 32 of the receptacle 30 can receive a seal 40. The seal 40 can cover the top opening of the receptacle 30. The seal 40 can be adhered to the upper rim 32 using any appropriate adhesive.

The seal 40 can provide a barrier for the interior storage chamber. When lid 20 is attached to the receptacle 30, the seal 40 can provide a barrier between the interior storage chamber and the interior headspace. In some embodiments, the seal 40 may be taut and substantially aligns with a plane of the upper rim 32 of the receptacle 30. Alternatively, the seal 40 may be relaxed, or have some slack, and concaves into the top opening of the receptacle 30. The seal 40 is considered to provide a barrier for the interior storage chamber irrespective of whether the seal 40 is taut or relaxed.

In some embodiments, the seal 40 can be formed of frangible material such as foil, plastic, or paper material. When the seal 40 is formed of a frangible material, manipulation of the seal 40 can cause damage to the seal 40. Use of a frangible seal 40 allows tampering, or manipulation of the seal 40 after it is initially adhered to the upper rim 32 of the receptacle 30 to be identifiable.

In some embodiments, the seal 40 adhered to the upper rim 32 of the receptacle can provide a leak-proof barrier for the contents within the interior storage chamber. Any appropriate material for the seal 40 and adhesives to adhere the seal 40 to the upper rim 32 can be used to provide the leak-proof barrier.

Figure 5:
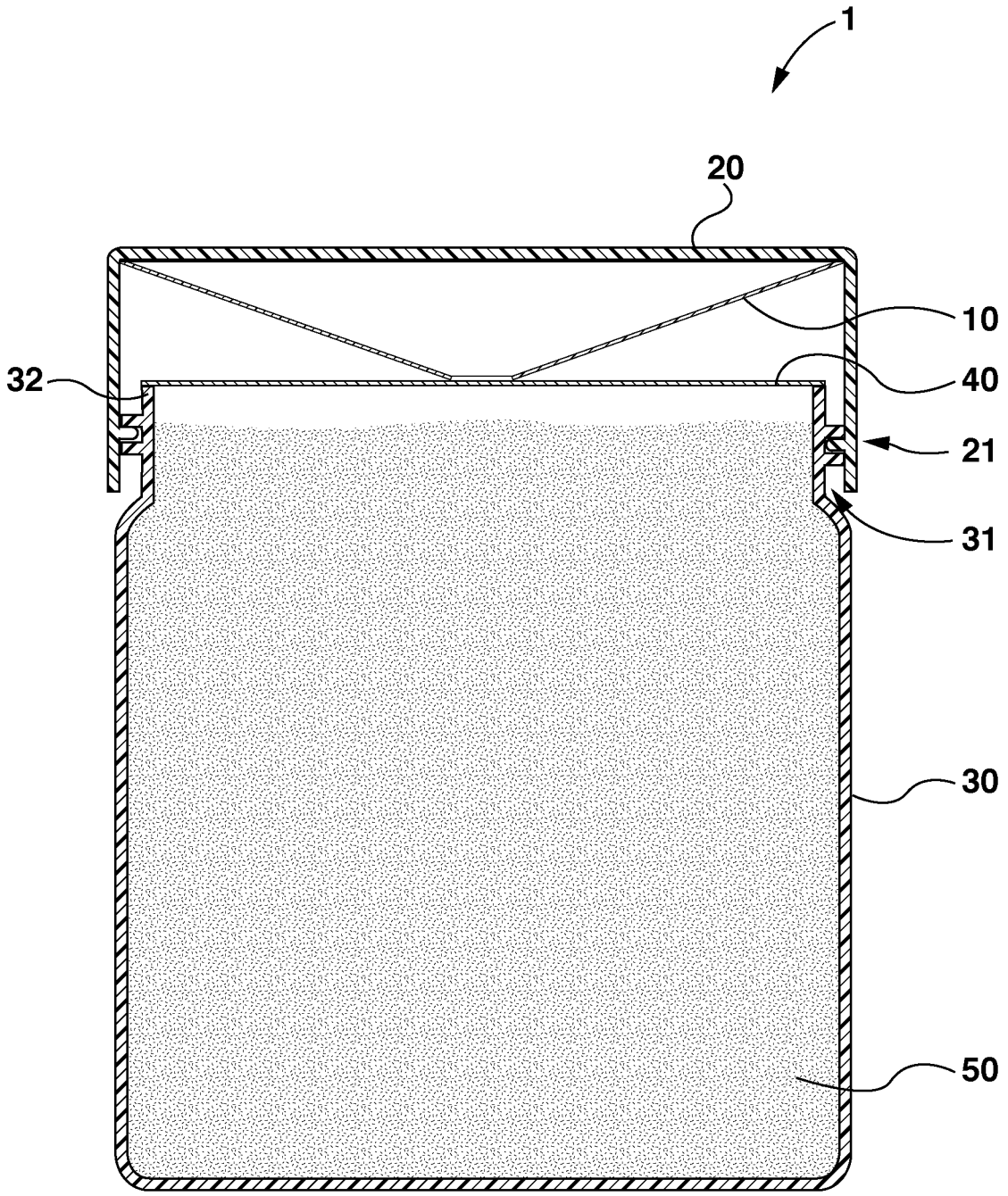
FIG. 5 is a cross-sectional view of a container having the receptacle and seal of FIG. 4B and the funnel and lid of FIG. 2.
Figure 6:
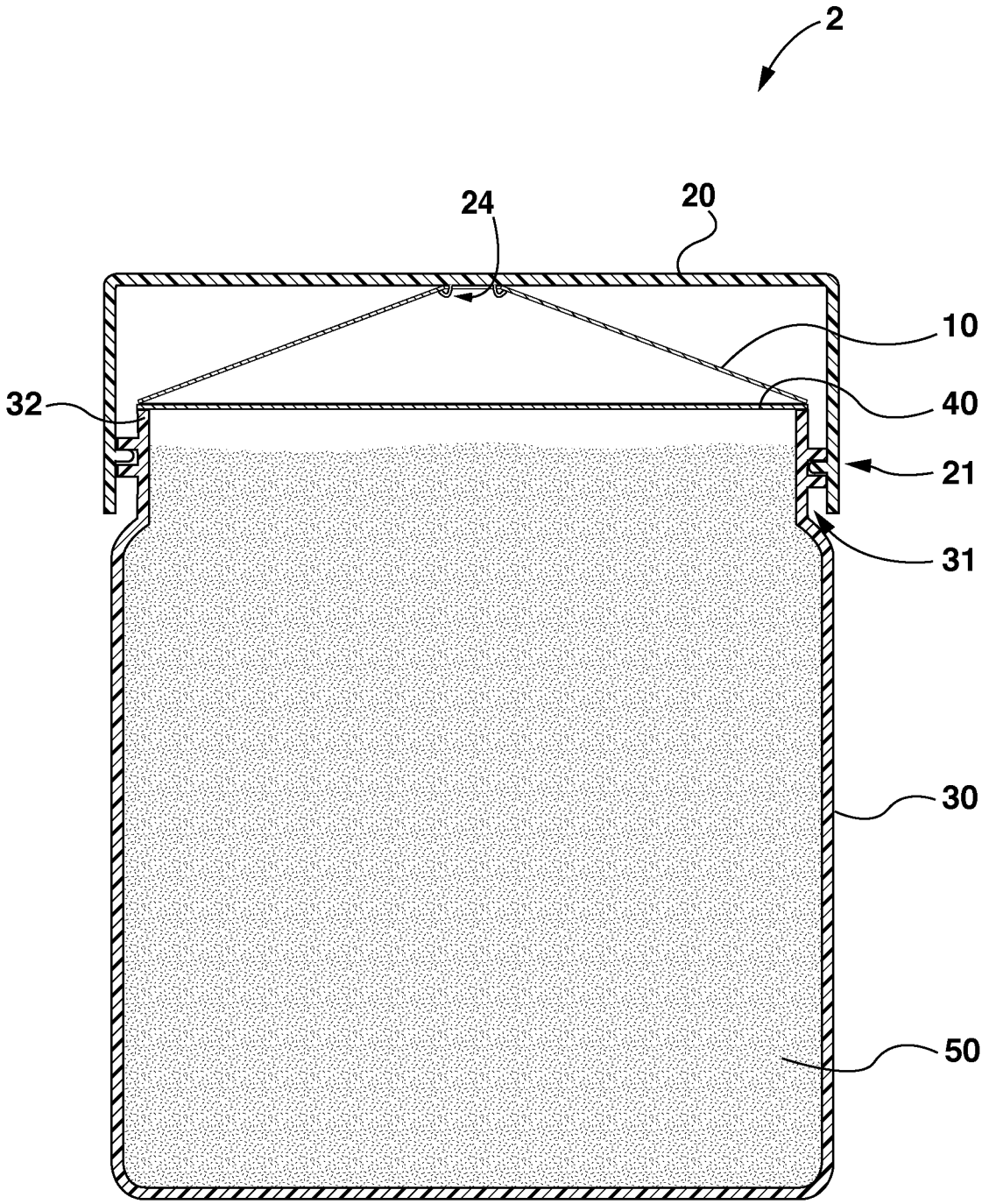
FIG. 6 is a cross-sectional view of the container of FIG. 5 with the funnel in a different orientation.

Reference is made to FIGS. 5 and 6, which illustrate cross-sectional views of containers 1 and 2, each container including the funnel 10, the lid 20, the receptacle 30, and the seal 40. As shown in FIGS. 5 and 6, an upper rim 32 of the receptacle 30 can receive the seal 40. The interior storage chamber of the receptacle 30 can store substances 50. Fastening means 31 on the outer surface of the receptacle 30 can receive the fastening means 21 on the interior sidewall 22 of the lid 20.

FIGS. 5 and 6 also show the funnel 10 shaped to fit within the interior headspace of the lid 20. The interior headspace has an upper boundary defined by the interior surface 23 of the lid 20, side boundaries defined by the interior sidewall 22 of the lid 20, and a lower boundary defined by the upper rim 32 of the receptacle 30. The funnel 10 is shaped and sized so that it does not pierce, puncture, or break the seal 40. More specifically, the rim 12 of the outlet end of the funnel does not have sharp edges that may cut, puncture, tear, or otherwise damage the seal 40. As well, the funnel height 10*c* is sized so that it does not impale, pierce, puncture, or otherwise damage the seal 40.

In FIG. 5, the funnel 10 is oriented with the inlet end of the funnel 10 adjacent to, or against, the interior surface 23 of the lid 20. In contrast, in FIG. 6, the funnel 10 is oriented with the outlet end of the funnel 10 adjacent to, or against, the interior surface 23 of the lid 20.

Attaching means for removably attaching the funnel 10 to the interior headspace are not shown in FIG. 5. However, when the funnel 10 is oriented as shown in FIG. 5, one or more protruding seats can be disposed along the interior sidewall 22 of the lid 20 to removably attach the funnel 10 to the lid 20. The protruding seats can be spaced a distance below the interior surface 23 that is at least the thickness 11*a* of the lip 11 at the inlet end of the funnel 10. The funnel 10 may be pinched, or deformed at the inlet end and in a direction away from the interior sidewall 22 of the lid 20 to release the funnel 10 from the one or more protruding seats.

Attaching means 24 for removably attaching the funnel 10 to the interior headspace are is shown in FIG. 6. In FIG. 6, the attaching means 24 is provided by one or more clasps disposed along the interior surface 23 of the lid 20 to removably attach the funnel 10 to the lid 20. The clasps protrude downwardly, or outwardly from the interior surface 23 of the lid 20 and fit within the outlet end of the funnel 10.

Alternatively, when the funnel 10 is oriented as shown in FIG. 6, one or more protruding seats can be spaced a distance below the interior surface 23 that is at least the funnel height 10*c* to removably attach the funnel 10 to the lid 20. The funnel 10 may be pinched, or deformed at the inlet end and in a direction away from the interior sidewall 22 of the lid 20 to release the funnel 10 from the one or more protruding seats.

In some embodiments, the funnel 10 may not be attachable to the interior headspace of the lid 20. With the orientation shown in FIG. 6, the width 10*a* of the inlet end may be sized to sit on the upper rim 32 of the receptacle 30. However, when the funnel 10 is not attachable to the lid 20, the funnel 10 may become displaced and impede the lid 20 from being attached to the container. The funnel may also become displaced and inadvertently fall through the top opening and into the interior storage chamber.

In some embodiments, the funnel 10 may be initially attached to the interior headspace of the lid 20 but not removably attachable, or repeatably attachable. For example, the funnel 10 may be initially attached to the lid 20 using an adhesive. Alternatively, the funnel 10 and the lid 20 may both be formed of the same material, such as plastic, and connected by frangible joints. The funnel 10 may be twisted, or torn, off at the frangible joints to separate the funnel 10 from the lid 20. Such embodiments may be appropriate when the container is generally a one-time use container. For example, the container may store a single dosage of a substance that is used all at once.

Numerous specific details are set forth herein in order to provide a thorough understanding of the exemplary embodiments described herein. However, it will be understood by those of ordinary skill in the art that these embodiments may be practiced without these specific details. In other instances, well-known methods, procedures and components have not been described in detail so as not to obscure the description of the embodiments. Furthermore, this description is not to be considered as limiting the scope of these embodiments in any way, but rather as merely describing the implementation of these various embodiments.

The invention claimed is:

1. A container comprising:

(a) a receptacle defining an interior storage chamber, the receptacle having an upper rim defining a top opening;

(b) a lid for enclosing the top opening, the lid being removably attachable to the receptacle, the lid comprising an interior surface, the lid defining an interior headspace between the upper rim of the receptacle and the interior surface of the lid;

(c) a funnel comprising a unitary body shaped to fit within the interior headspace, wherein when the lid is attached to the receptacle and the funnel is received within the interior headspace the funnel maintains a funnel shape without assembly; and (d) a seal received by the upper rim, the seal for covering the top opening, wherein the seal provides a frangible barrier between the interior storage chamber and the interior headspace.

2. The container of claim 1, wherein the frangible barrier remains unbroken when the funnel is placed within the interior headspace.

3. The container of claim 1, wherein the lid further comprises an interior sidewall defining side boundaries of the interior headspace.

4. The container of claim 3, wherein the funnel is removably attachable to the interior headspace.

5. The container of claim 4, wherein the funnel further comprises an inlet end and an outlet end, the inlet end being wider than the outlet end, and a distance between the inlet end and the outlet end defining a funnel height.

6. The container of claim 5, wherein the unitary body is temporarily deformable for removing the funnel from the interior headspace.

7. The container of claim 6, wherein the lid further comprises a protruding seat disposed along the interior sidewall for retaining the funnel between the interior surface and the protruding seat.

8. The container of claim 7, wherein the protruding seat being located at a distance from the interior surface that is at least the funnel height.

9. The container of claim 7, wherein the funnel further comprises a lip disposed along the inlet end, the lip having a thickness defined by a distance between a bottom surface of the lip and a top surface of the lip.

10. The container of claim 9, wherein the protruding seat is located at a distance from the interior surface that is at least the thickness of the lip.

11. The container of claim 5, wherein the funnel further comprises a rim disposed along the outlet end.

12. The container of claim 11, wherein the lid further comprises a funnel clasp disposed along the interior surface for gripping the rim of the funnel.

13. The container of claim 3, wherein the receptacle further comprises a fastening member disposed along an outer surface of the receptacle.

14. The container of claim 13, wherein the lid further comprises a fastening member that is complementary to the fastening member of the receptacle for removably attaching the lid to the receptacle.

15. The container of claim 14, wherein the fastening member of the lid is disposed along the interior sidewall.

16. The container of claim 14, wherein the fastening member of the lid and the fastening member of the receptacle comprises threading.

17. The container of claim 1, wherein the seal is adhered to the upper rim by an adhesive.

18. The container of claim 1, wherein the frangible barrier is a leak-proof barrier.

19. A container comprising:

(a) a receptacle defining an interior storage chamber, the receptacle having an upper rim defining a top opening;

(b) a lid for enclosing the top opening, the lid being removably attachable to the receptacle, the lid comprising an interior surface, the lid defining an interior headspace between the upper rim of the receptacle and the interior surface of the lid;

(c) a funnel comprising a unitary body shaped to fit within the interior headspace, wherein when the lid is attached to the receptacle and the funnel is received within the interior headspace the funnel maintains a funnel shape without assembly; and (d) a seal received by the upper rim, the seal for covering the top opening, wherein the seal is adhered to the upper rim by an adhesive.

* * * * *